US010760321B2

(12) United States Patent
Evans

(10) Patent No.: US 10,760,321 B2
(45) Date of Patent: Sep. 1, 2020

(54) THERMAL DOOR RELEASE SYSTEM

(71) Applicant: Rob J. Evans, Glendale, AZ (US)

(72) Inventor: Rob J. Evans, Glendale, AZ (US)

( * ) Notice: Subject to any disclaimer, the term of this patent is extended or adjusted under 35 U.S.C. 154(b) by 256 days.

(21) Appl. No.: 15/965,771

(22) Filed: Apr. 27, 2018

(65) Prior Publication Data

US 2018/0313132 A1 Nov. 1, 2018

Related U.S. Application Data

(60) Provisional application No. 62/491,198, filed on Apr. 27, 2017.

(51) Int. Cl.

| | |
|---|---|
| ***E05F 15/72*** | (2015.01) |
| ***E05F 15/71*** | (2015.01) |
| ***E05F 1/00*** | (2006.01) |
| ***A62C 2/24*** | (2006.01) |

(52) U.S. Cl.

CPC ..... *E05F 15/72* (2015.01); *A62C 2/24* (2013.01); *E05F 1/006* (2013.01); *E05F 15/71* (2015.01); *E05Y 2201/404* (2013.01); *E05Y 2400/44* (2013.01); *E05Y 2400/52* (2013.01); *E05Y 2400/81* (2013.01); *E05Y 2800/414* (2013.01); *E05Y 2800/416* (2013.01); *E05Y 2900/102* (2013.01); *E05Y 2900/106* (2013.01); *E05Y 2900/134* (2013.01)

(58) Field of Classification Search

CPC ..... E05Y 1/006; E05Y 3/222; E05Y 15/72; E05Y 2015/434; E05Y 2015/71; E05Y 2201/41; E05Y 2400/10; E05Y 2400/44; E05Y 2400/52; E05Y 2800/414; E05Y 2800/416; E05Y 2900/00; E05Y 2900/40; E05Y 2900/134; E05Y 2900/146; E05Y 2900/531; E05Y 15/71; E06B 5/16; A62C 2/24

See application file for complete search history.

(56) References Cited

U.S. PATENT DOCUMENTS 4,884,222 A * 11/1989 Nagashima ..... G08B 17/00 340/506
4,999,615 A * 3/1991 Toupin ..... G01K 11/06 340/590

(Continued)

*Primary Examiner* — Crystal J Barnes-Bullock

(74) *Attorney, Agent, or Firm* — Morgan Law Offices, PLC

(57) ABSTRACT

A thermal door release system is provided that includes a plurality of temperature sensors arranged within multiple environments; a controller; and a release apparatus; wherein the controller, using data from the temperature sensors, monitors the temperatures of the individual environments and when a temperature for an environment reaches a set temperature threshold for that environment, causes an action such as the release apparatus to operate a door to a specified position. The set points and actions to be taken can be set per environment by a user, such that different environments will have different set points. In an embodiment, the system can support staged logic such that at various different user-defined set point temperatures for an environment, specified actions can be taken, for example, sending an email to the facilities manager when the temperature is significantly above normal and closing the door when it reaches a higher set point value.

14 Claims, 4 Drawing Sheets

(56) References Cited

U.S. PATENT DOCUMENTS 5,260,687 A * 11/1993 Yamauchi ..... G08B 17/00 340/511
5,642,767 A * 7/1997 Nair ..... A62C 2/18 160/189
6,155,921 A * 12/2000 Evans ..... A62C 2/12 169/49
6,215,405 B1 * 4/2001 Handley ..... G08B 17/06 340/521
6,285,291 B1 * 9/2001 Knox ..... G08B 17/107 340/634
6,480,103 B1 * 11/2002 McCarthy ..... E05B 83/26 340/425.5
6,621,411 B2 * 9/2003 McCarthy ..... E05B 83/26 180/287
7,097,226 B2 * 8/2006 Bingle ..... E05B 83/26 296/76
7,221,289 B2 * 5/2007 Hom ..... G08G 1/042 340/501
8,991,115 B2 * 3/2015 Hubbard ..... A62C 2/24 52/173.3
9,013,317 B2 * 4/2015 Brigham ..... G08B 17/107 340/584
9,355,541 B1 * 5/2016 Lewinski ..... B64D 45/00
9,472,078 B2 * 10/2016 Pandey ..... G08B 29/06
9,761,119 B1 * 9/2017 Trundle ..... G08B 25/004
9,814,311 B2 * 11/2017 Mueller ..... A47B 81/00
10,000,961 B2 * 6/2018 Elie ..... E05F 15/40
2004/0104580 A1 * 6/2004 Spiessl ..... D06F 37/42 292/84
2005/0162268 A1 * 7/2005 Grindstaff ..... G08B 13/19641 340/531
2006/0229740 A1 * 10/2006 Kreisel ..... H02H 3/006 700/22
2011/0024405 A1 * 2/2011 Bradley ..... B23K 26/0096 219/121.72
2012/0240474 A1 * 9/2012 Purssey ..... E05F 3/223 49/506
2013/0079955 A1 * 3/2013 Masiello ..... G01J 5/025 701/3
2013/0205692 A1 * 8/2013 Hubbard ..... A62C 2/24 52/173.3
2015/0297930 A1 * 10/2015 Nikkarila ..... A62C 37/36 169/46
2015/0348385 A1 * 12/2015 Lamb ..... G08B 13/08 340/547
2016/0165760 A1 * 6/2016 Kutsuzawa ..... H05K 7/20736 361/679.5
2017/0032633 A1 * 2/2017 Lamb ..... G08B 13/08

* cited by examiner

THERMAL DOOR RELEASE SYSTEM

CROSS-REFERENCE TO RELATED APPLICATIONS

This application claims the benefit of provisional application Ser. No. 62/491,198 to Rob J. Evans, filed on Apr. 27, 2017 and entitled "THERMAL DOOR RELEASE SYSTEM," the subject matter of which is incorporated herein by reference.

BACKGROUND

1. Field

The application relates to operation of doors that isolate smoke and flame from a non-burning area 2. Description of the Related Art When a fire is detected in a building having fire doors, the fire doors must be kept closed. Keeping these doors closed helps to compartmentalize the fire. In the case of motorized rolling fire doors, fire detection devices are conventionally situated well above the doors or near the ceiling. A typical motorized rolling fire door will include a fusible link disposed a foot or more above the door. A fusible link is made from pieces of metal held together by solder designed to melt when it reaches a certain high temperature. When the fire detection device detects a fire because one or more of the fusible links has melted, the fire doors will be automatically closed. However, in many instances it may be desirable to take action if the temperature is higher than normal though not at the point where the fusible links melt. For example, in a cooler, temperatures normally would be less than 40 degrees F. During the early stages of a fire, the temperature in the cooler would be higher than normal but might not yet be enough to melt a fusible link. As another example, where the indoor temperature in an area is tightly controlled, a significant deviation from the temperature might indicate an abnormal situation warranting alerting a building supervisor or perhaps closing the doors.

SUMMARY

A thermal door release system is provided that includes a plurality of temperature sensors arranged within multiple environments; a controller; and a release apparatus; wherein the controller, using data from the temperature sensors, monitors the temperatures of the individual environments and when a temperature for an environment reaches a set temperature threshold for that environment, causes an action to release or operate a door to a specified position. The user can establish the release points and actions to be taken for each of the environments, such that different environments may have different release points. In an embodiment, staged logic is supported such that at various different user-defined set point temperatures for an environment, specified actions can be taken, for example, sending an email to the facilities manager when the temperature is significantly above normal and then closing the door only if it reaches a higher release point value.

DETAILED DESCRIPTION

Details of the various embodiments will now be discussed by reference to the drawings.

Figure 1:
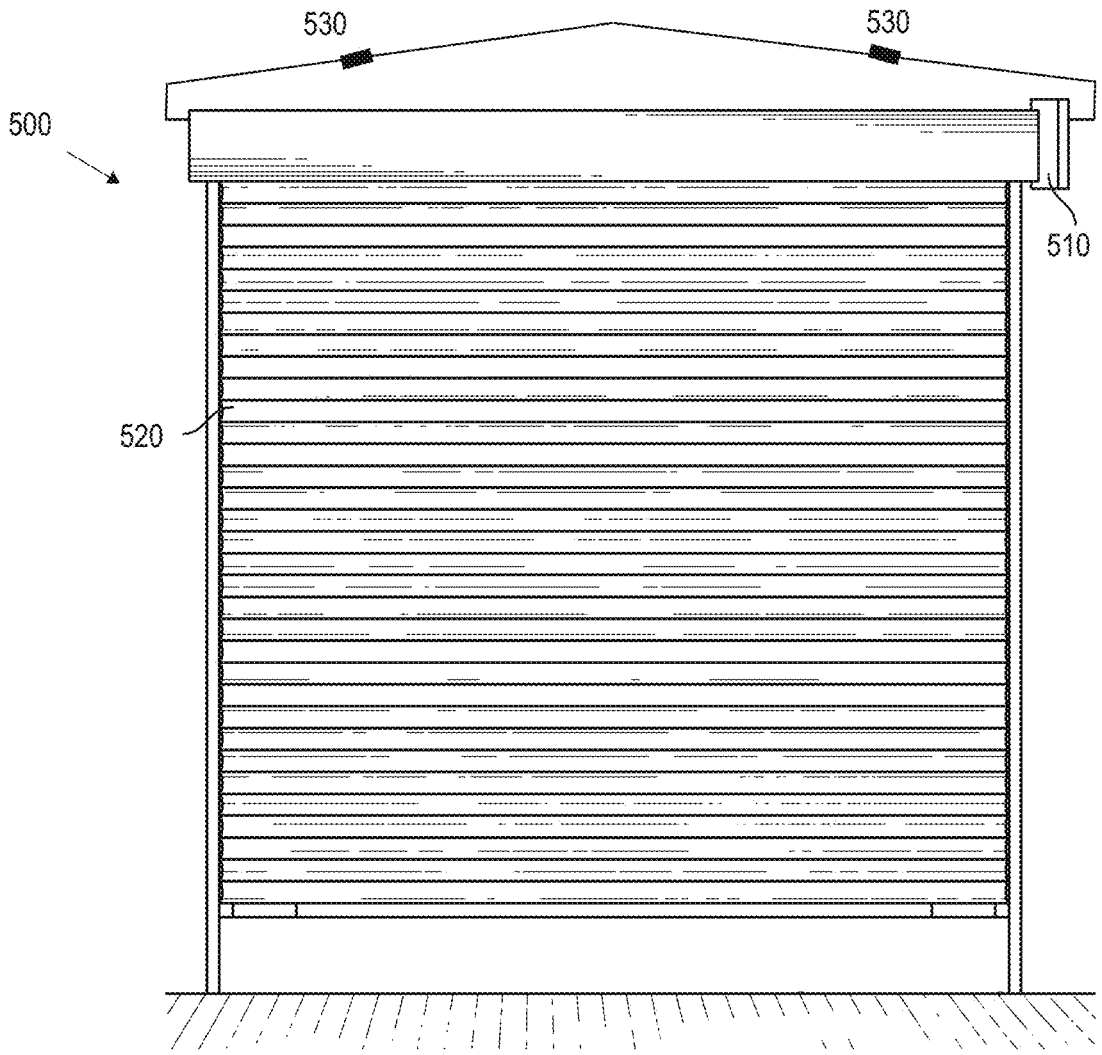
FIG. 1 (PRIOR ART)
FIG. 1 illustrates a prior art rolling motorized fire door having fusible links disposed above the door.

Referring to FIG. 1, a prior art motorized rolling fire door having fusible links disposed above the door is illustrated. As shown, the fire door 500 includes a motor control system 510 that controls operation of a gate 520. In general, the fire door 500 should be closed when a fire is detected. Fusible links 530 are disposed above the fire door 500. The fusible links 530 may be made from pieces of metal held together by solder designed to melt when they reach a certain temperature causing an open circuit condition. In this case, a fire alarm system is activated, and the motor control system 510 causes the gate 520 to close, for example, by de-energizing an electromagnet holding the door in an open position. It should be understood, however, that the fire alarm system could be activated in other ways, such as by detection of smoke using smoke sensors or a person manually pulling a fire alarm. Additionally, it is to be understood that although a motorized rolling door is depicted, various other types of fire doors having release systems, including sliding doors and hinged doors, are also widely in use.

Figure 2:
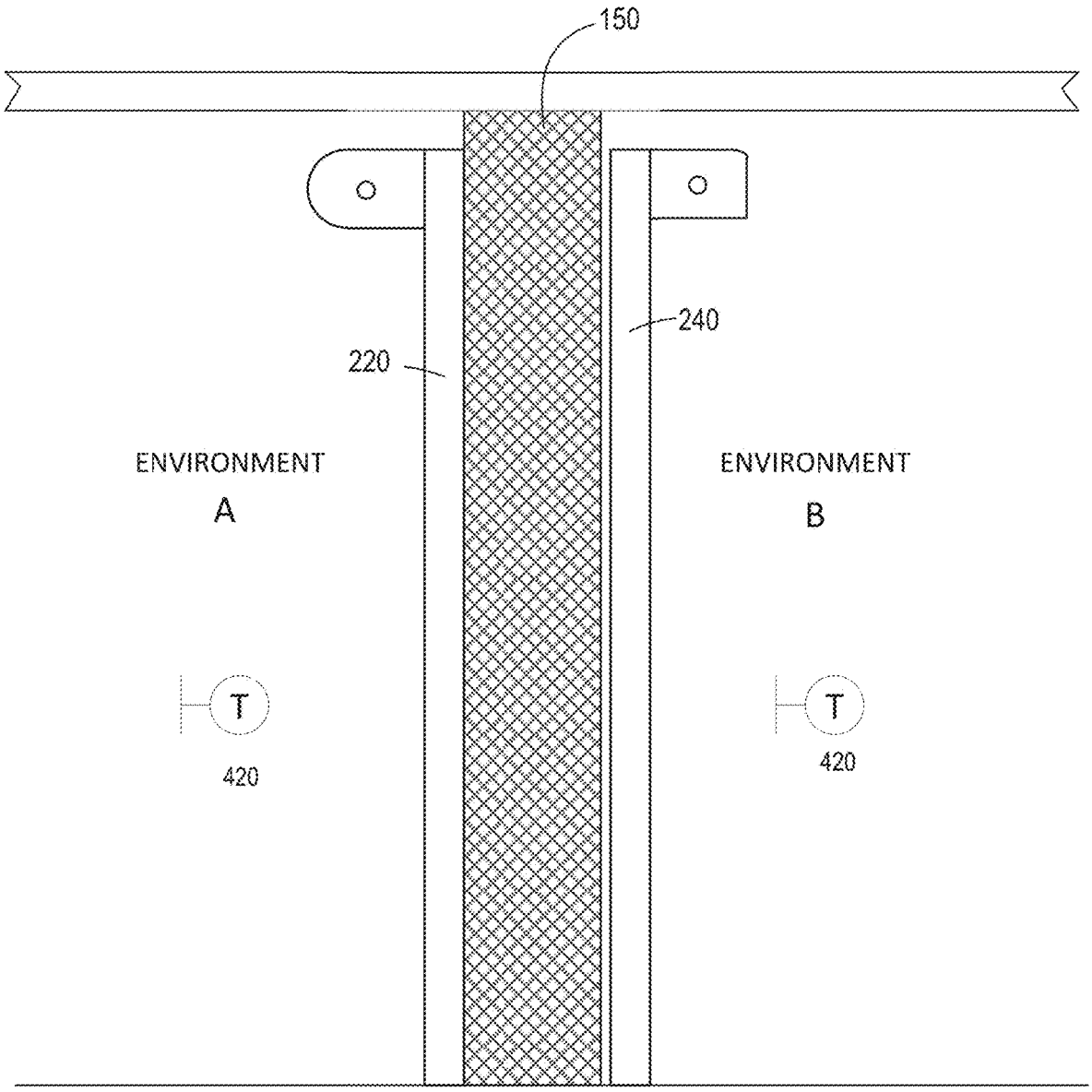
FIG. 2 illustrates examples of multiple environments for use in a thermal door release system, according to embodiments described herein.

FIG. 2 illustrates an example of multiple environments that can be separately regulated, according to embodiments described herein. On the left side of a wall 150, an environment A in which a warehouse area is provided with a fire door 220 is shown. On the right side of the wall 150, an environment B in which a cooler is kept at about 40 deg. F. is shown. The environment B includes a high-speed door 240 that operates throughout the day. As will be described in greater detail, a thermal door release system described herein monitors both environments A and B for respective current room temperatures and corresponding user-defined release points. For the warehouse environment A, the temperature triggering the fire door 210 closure (and/or other actions) is set to 165 deg. F., for example. The cooler does not need to reach 165 deg. F. for an emergency condition to exist. Accordingly, the temperature triggering the fire door 210 closure (and/or another action) for the cooler environment B could be set at a much lower temperature. It is to be understood that the environments shown in FIG. 2 are non-limiting examples, and the system could be used in conjunction with various other environments. It is also to be understood that such environments need not be contiguous or share a single fire door, as depicted in FIG. 2.

Figure 3:
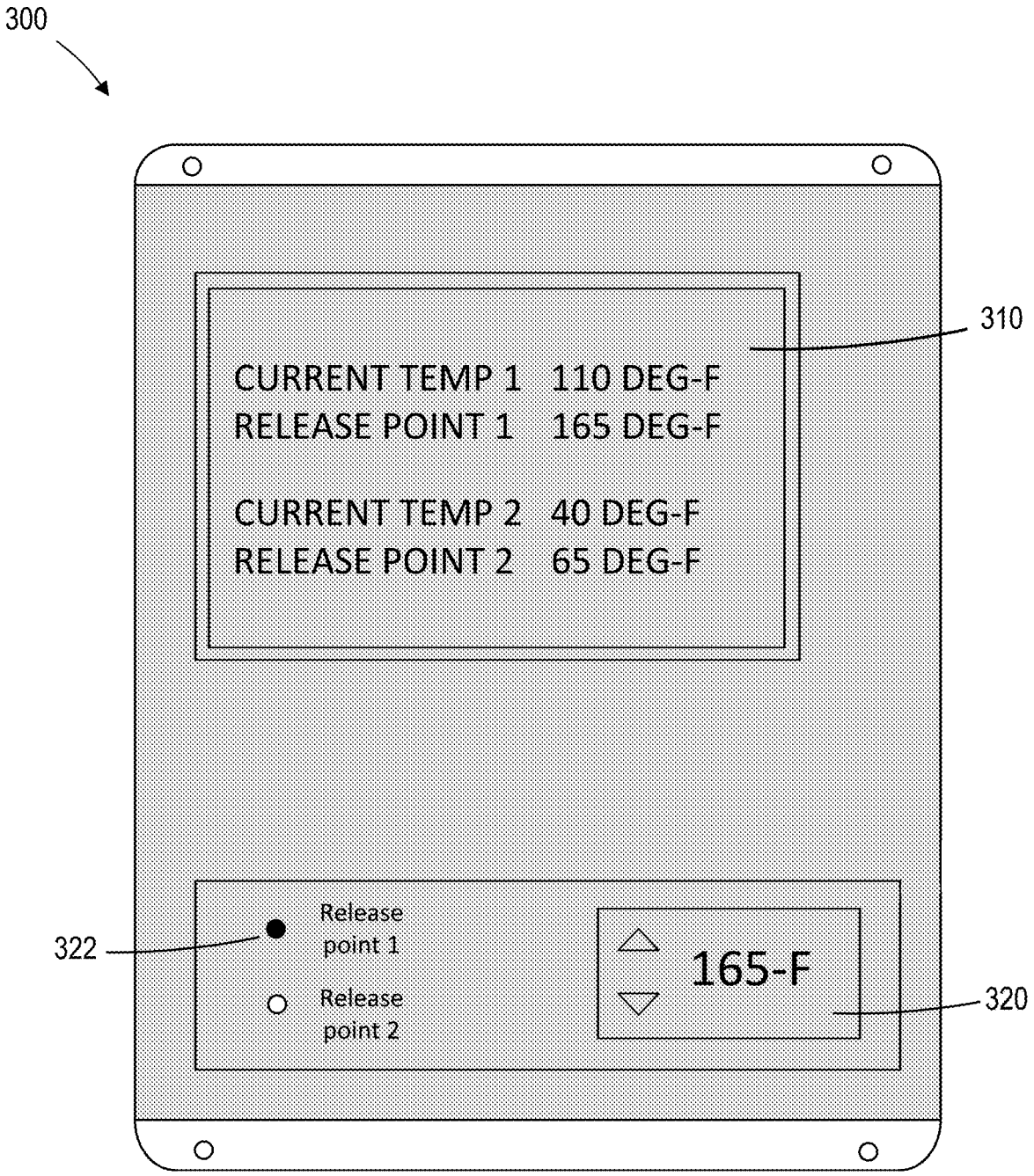
FIG. 3 illustrates an example user interface console useable with embodiments described herein.

FIG. 3 illustrates an exemplary user interface console 300. As shown in display window 310, the current temperature for the warehouse environment A is displayed as 110 deg. F. The release point for the warehouse environment A is set at 165 deg. F. The current temperature for the cooler environment B is shown as 40 deg. F. The release point for the cooler is set at 65 deg. F. It is to be understood that the user interface shown in FIG. 3 is merely provided for illustrative purposes, and other such display devices and/or screen layouts could be used. Also depicted in FIG. 3 is a user-setting input device 320 that allows a user to define the release points for each environment. As shown, the user has selected to adjust Release Point 1 by selecting release point selection button 322. Then user has selected 165 F. as the release point temperature for Environment A. Similarly, the user may set the release point temperature for Environment B by selecting the Release Point 2 point selection button and entering the release point temperature for that selection. Although up/down arrows are shown for entering release point temperatures, it is be understood that a user interface could be used such that the release point temperatures could be entered in another manner, e.g., entering the temperature using a number pad. Notably, the release points can be adjusted to meet "authority having jurisdiction" requirements that can be specifically tailored outside of accepted code. Alternatively, the user interface could be implemented as a software application for use with a computing system (e.g., desktop, laptop, tablet) instead of being implemented as a dedicated console.

Figure 4:
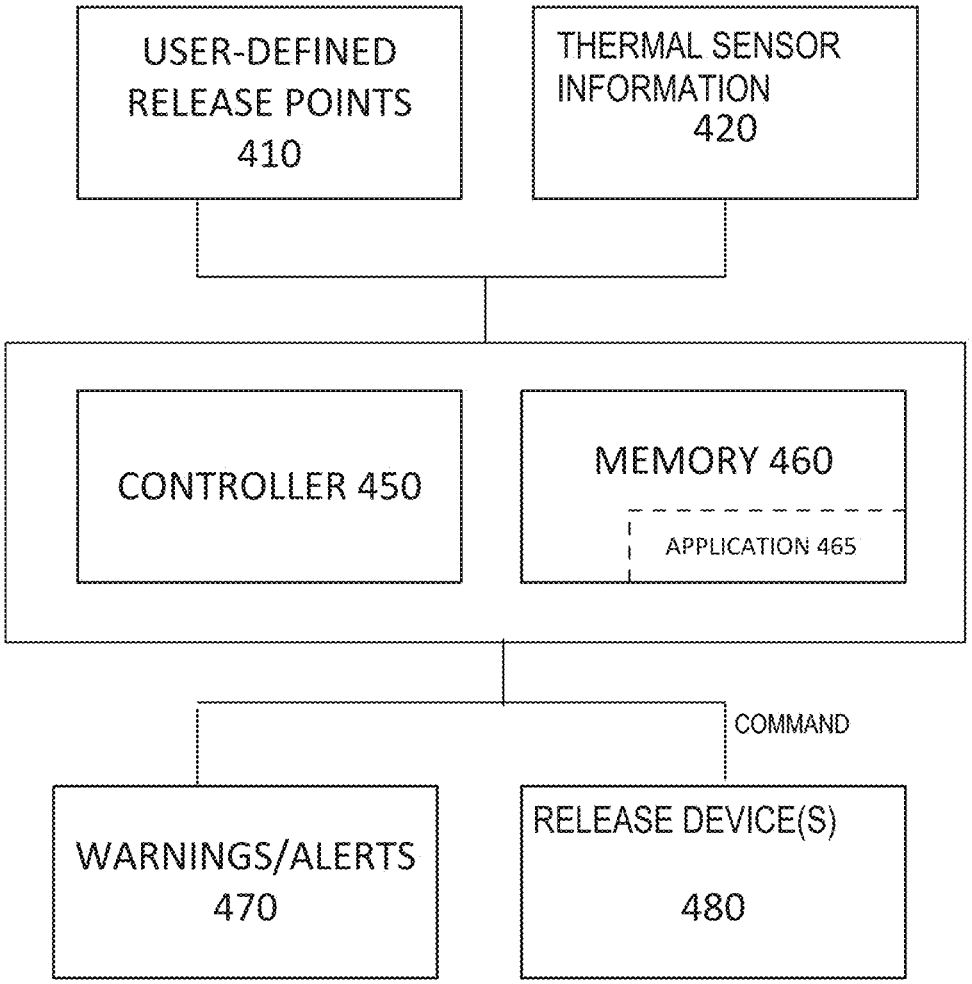
FIG. 4 illustrates a block diagram of an example thermal door release system, according to embodiments.

FIG. 4 illustrates a block diagram for an exemplary thermal door release system 100. As shown, the thermal door release system 100 includes a controller 450 and memory 460 (including a stored set of instructions embedded thereon herein referred to as application 465). The controller 450 can be a programmable logic controller (PLC) or the like. The application 465 can include program code to instruct the PLC. Alternatively, the controller 450 can be another type of computing device or even a hardwired circuit. The inputs into the controller 450 include user-defined release points 410 (which may be obtained from the user interface 300 and/or other input sources) and inputs from thermal sensors 420 (such as thermometers in each of the environments). The outputs include warnings/alerts 470 (such as an audible or visual alarm or an email text warning, in certain embodiments) and commands to release devices 480 (such as a "close" instruction to an electromagnetic door release).

The thermal door release system 100 may be integrated into a fire alarm system or be a separate system from the fire alarm system. Additionally, the thermal door release system 100 may be connected to one or more smoke sensor or the like. The thermal door release system 100 could be directly linked to a fire door. In this case, the required linkage could be connected to an electromagnetic release or the like. Common door linkages may extend from the torsions side and drive side head plates. It is to be understood that the thermal door release system 100 could alternatively operate remotely, e.g., be linked via a communication network, either wired or wirelessly, to several doors having the release devices/linkages. Additionally, it is to be understood that a power supply for the system 100 could include back-up batteries that operate the device in the event of a primary power lines loss. In various embodiments, the thermal door release system 100 engages gearing and tension for fire doors to operate under normal circumstances as well. Additionally, the drive side may employ either a mechanical or a viscous type governor that controls the speed at which the door closes. The fire door can be electrically driven and speed monitored by an encoding device and back-driven reduction rotates the door closed under negative counter balance and biasing of gravity.

By way of example, the thermal door release system 100 will be discussed in relation to the multiple environments A and B described above (FIG. 2). However, it is to be understood that the environments A and B described herein are non-limiting examples, and the system 100 could be used in conjunction with various other environments.

In operation, the controller 450 receives user-defined release points 410 which define the release points for each of the environments A and B. In the example, the release point for Environment A (warehouse) is set at 165 degrees F. and the release point for Environment B (cooler) is set at 65 degrees F. It is to be understood that the user can change the release points, and if that happens, the controller 450 will use the most current user-defined release points. Additionally, the controller 450 continually receives thermal sensor information 420 (which can be obtained from thermometers or other thermal sensors situated in each of the Environments A and B). The controller 450 is programmed to compare the current temperature of each environment (obtained from the thermal sensor information 420) against the release point for each of the respective environments). If the current temperature reaches or exceeds the release point for an environment, the controller 450 directs a predetermined action to be taken. In an embodiment, the action taken is to signal to the door release system to move the fire door 220 to a specified position (e.g., closed). The controller 450 can also be programmed to do likewise if certain other predetermined inputs are received, e.g., smoke alarm activation, an alarm being pulled, fusible link breakage, regardless of whether the release point temperature has been reached or exceeded.

In various embodiments, staged logic outputs are triggered. The outputs can be set in direct relation to the measured temperatures. Referring again to the example illustrated in FIG. 2, the release point for Environment B (cooler) can be set to 65 deg. F. (as was mentioned, the typical temperature in such an environment is 40 deg. F.). However, under "staged logic", a first release could be set to output an audible and/or visual signal at 50 deg. F. If the temperature then goes below 50 deg. F., the output would be turned off. Alternatively, if the temperature rises to 55 deg. F., the second release could be set to send email to a facilities engineer or the like, for example, alerting the recipient as to this situation. (The release device can be Wi-Fi-connectable with an email platform). Once a third release point of 65 deg. F. is reached, the system could be set to activate the fire door in drop mode to close the door. The staged logic version described herein would require that the user interface accommodate a mechanism to input the information needed to effect the staged logic such as the various release temperatures and actions to be taken at each stage, for each of the environments. Notably, in various embodiments, all temperature release points may be fully adjustable at the visual interface and can be set outside fire code and at the sole discretion for the "authority having jurisdiction" such as the local fire marshal.

While this invention has been described in conjunction with the various exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A thermal door release system, comprising:

a plurality of thermometers arranged within multiple environments, each of the environments including at least one separate room having at least one of the thermometers;

a controller;

a user interface console operatively coupled to the controller, the user interface console adapted to receive a user-inputted release point temperature for each of the environments, wherein the user-inputted release point temperatures can be different; and a release apparatus;

wherein the controller, using thermal sensor information from the thermometers, monitors the temperatures of the individual environments and when a measured temperature for a first one of the environments, determined using the thermal sensor information, reaches a first release point_temperature for that environment as input into the user interface console for that environment, causes a first action, and when a measured temperature for a second one of the environments reaches a second release point temperature for that environment as input into the user interface console for that environment, causes a second action.

2. The thermal door release system of claim 1, wherein at least one of the first action and the second action is the release of a door to a specified position.

3. The thermal door release system of claim 1, wherein at least one of the first action and the second action is an audible alarm.

4. The thermal door release system of claim 1, wherein the at least one of first action and the second action is a visual alarm.

5. The thermal door release system of claim 1, wherein at least one of the first action and the second action is sending an email message.

6. The thermal door release system of claim 5, wherein the email message includes a warning.

7. The thermal door release system of claim 1, wherein the controller causes the release apparatus to operate a door to a specified position when the fusible link melts.

8. The thermal door release system of claim 1, wherein the controller detects if the fusible line is connected.

9. The thermal door release system of claim 1, wherein a battery backup is used during a primary power line loss.

10. The thermal door release system of claim 1, wherein the system is connected as a client to a network.

11. The thermal door release system of claim 1, wherein the thermal release temperature input into the user interface console for the first one of the environments is different from the thermal release temperature input into the user interface console for the second one of the environments.

12. The thermal door release system of claim 1, wherein at least one thermal release temperature input into the user interface console is outside of accepted fire code.

13. The thermal door release system of claim 1, wherein at least one of the thermal release temperatures input into the user interface console is outside of accepted code.

14. The thermal door release system of claim 1, wherein at least one of the thermal release temperatures input into the user interface console is a value adjusted to meet authority having jurisdiction requirements.

* * * * *